US012448860B1

(12) United States Patent
Horvath et al.

(10) Patent No.: US 12,448,860 B1
(45) **Date of Patent: *Oct. 21, 2025**

(54) INTERNAL LATCHING APPARATUS

(71) Applicant: ZP INTERESTS, LLC, Spring, TX (US)

(72) Inventors: Balazs Horvath, Veszprem (HU); Mario Munoz Reyna, Pasadena, TX (US); Charles W. Bedford, Hempstead, TX (US)

(73) Assignee: ZP INTERESTS, LLC, Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/771,059

(22) Filed: Jul. 12, 2024

Related U.S. Application Data

(63) Continuation of application No. 17/168,283, filed on Feb. 5, 2021, now Pat. No. 12,060,759.

(60) Provisional application No. 62/971,573, filed on Feb. 7, 2020.

(51) Int. Cl.

| | |
|---|---|
| ***E21B 33/038*** | (2006.01) |
| ***E21B 23/02*** | (2006.01) |
| *E21B 33/12* | (2006.01) |

(52) U.S. Cl.
CPC ..... *E21B 33/038* (2013.01); *E21B 23/02* (2013.01); *E21B 33/1208* (2013.01)

(58) Field of Classification Search
CPC ... E21B 33/038; E21B 33/10208; E21B 23/02
USPC ..... 285/335
See application file for complete search history.

(56) References Cited

U.S. PATENT DOCUMENTS

| | | | | |
|---|---|---|---|---|
| 5,083,031 | A | 1/1992 | Hoelsher | |
| 6,059,501 | A | 5/2000 | Van Dyke | |
| 6,845,644 | B1 | 1/2005 | Buckner | |
| 9,169,711 | B2 | 10/2015 | Raynal | |
| 2014/0183824 | A1 * | 7/2014 | Benson | E21B 33/04 277/339 |
| 2015/0114622 | A1 | 4/2015 | Gadre | |
| 2019/0249387 | A1 | 8/2019 | Horie | |
| 2019/0309882 | A1 | 10/2019 | Huggins | |

* cited by examiner

*Primary Examiner* — Tara Schimpf
*Assistant Examiner* — Patrick F Lambe
(74) *Attorney, Agent, or Firm* — Shackelford, McKinley & Norton, LLP; David L. Odom

(57) ABSTRACT

An internal locking ring assembly for a wellhead system that includes a compact single body locking ring design that eliminates the need for a separate casing head and housing configuration or the use of numerous lockdown pins, therefore increasing the safety of the entire drilling operation. The internal locking ring includes outer and inner diameter grooves and angles to accommodate a running tool for collapsing the locking ring for positing into wellhead seats all at lower forces than what is typical due to the lower retrieving torque when trying to retrieve the packoff. Such lower retrieving torque and force allows the use of smaller cross sections of a running tool.

21 Claims, 9 Drawing Sheets

INTERNAL LATCHING APPARATUS

1. CROSS-REFERENCE TO RELATED APPLICATIONS

This application is a continuation of, and incorporates by reference for any purpose, prior U.S. patent application Ser. No. 17/168,283, filed on Feb. 5, 2021. U.S. patent application Ser. No. 17/168,283 claims priority to, and incorporates by reference for any purpose, U.S. Provisional Patent Application Ser. No. 62/971,573, filed on Feb. 7, 2020.

2. BACKGROUND OF THE INVENTION

This section provides background information to facilitate a better understanding of the various aspects of the disclosure. It should be understood that the statements in this section of this document are to be read in this light, and not as admissions of prior art.

Field of the Invention

The invention relates generally to wellhead latch systems and, more particularly, to an internal locking ring having a plurality of inner and outer diameter grooves and beveled angles.

Description of Related Art

Companies often invest significant amounts of time and money in finding and extracting oil, natural gas, and other subterranean resources from the earth, all in the effort of meeting consumer and industrial demand for natural resources. Once a desired subterranean resource such as oil or natural gas is discovered, drilling and production systems located onshore or offshore, depending on the location of a specific resource, are often employed to access and extract the resource. These systems generally include wellhead assemblies comprising a wide variety of components including various spools, casings, valves, pumps, fluid conduits, etc. that control drilling or extraction operations mounted on wells, through which resources are accessed or extracted. Often times, casings are coupled to wellheads via hangers installed in bores of the wellheads. Such hangers and other components within the bores can be retained in various ways while sealing packoffs can be used to seal annular spaces within the bores.

Internal locking mechanisms are designed to mitigate exposure to working under a heavy load or in a confined space. The absence of external lock screws and unnecessary penetrations for locking in casing strings also eliminates associated leak paths and other concerns. Current known systems contain various types of latching devices and systems, but none have an internal locking ring comprising a plurality of grooves on the outer and inner diameter.

BRIEF SUMMARY OF THE INVENTION

This summary is provided to introduce a selection of concepts that are further described below in the Detailed Description. This summary is not intended to identify key or essential features of the claimed subject matter, nor is it to be used as an aid in limiting the scope of the claimed subject matter.

Embodiments of the present disclosure generally relate to internal locking rings that can be installed within a bore of a wellhead. In one embodiment, an internal locking ring includes at least one internal locking ring for a multi-bowl style wellhead system. The present invention provides a compact single body internal locking ring design that eliminates the need for a separate casing head and housing configuration and up to thirty-two lockdown pins (LDS). This provides an advantage over prior devices in that the internal locking ring of the present disclosure mechanically locks casing hangers and packoffs in the wellhead eliminating the need for lockdown pins and eliminates potential leak paths (i.e., body penetration). This design results in increased safety for the entire drilling operation.

The internal locking ring and system can also be run through a diverter riser when needed, due to its reduced outside dimensions (no LDS and rotating flange design. This saves drilling rig time and cost and can also save on operating costs by being installed via alternative equipment other than expensive rigs. In addition, embodiments of the present disclosure include outer and inner diameter grooves on the at least the inner and outer diameters of the locking ring. Such grooves allow a running tool to collapse the internal locking ring with less force due to the lower retrieving torque and force when trying to retrieve a packoff. Such lower retrieving torque and force allows the use of smaller cross sections for a running tool.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any aspect of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

The disclosure herein is best understood from the following Detailed Description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION OF THE INVENTION

Figure 1:
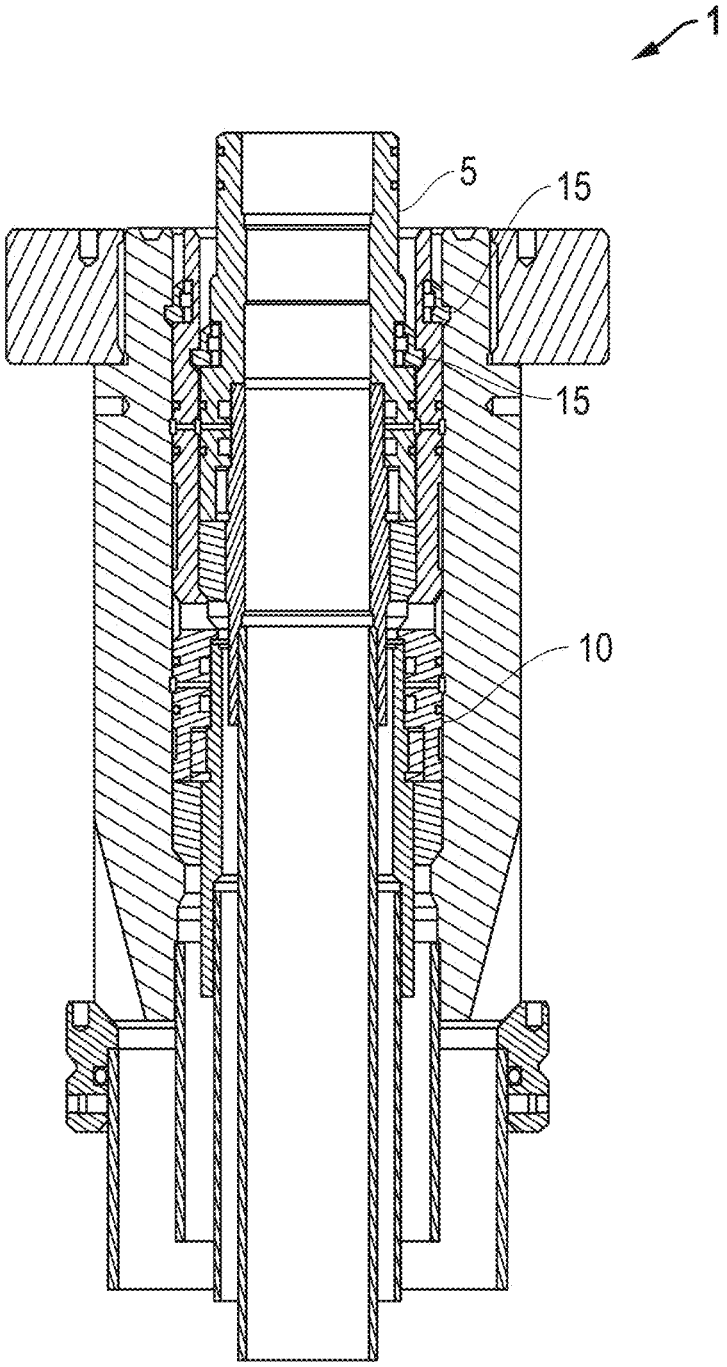
FIG. 1 illustrates a sectional elevation view of a wellhead incorporating internal locking rings for securing components within the wellhead in accordance with one embodiment of the present disclosure

In the following description, numerous specific details are set forth to provide a thorough understanding of the present invention. However, it will be apparent to those skilled in the art that the present disclosure may be practiced without such specific details. It is to be understood that both the foregoing general summary description and the following detailed description are illustrative and explanatory, and are not restrictive of the subject matter, as claimed. It is to be further understood that the following disclosure also provides many different embodiments, or examples, for implementing different features of various illustrative embodiments. Specific examples of components and arrangements are described below to simplify the disclosure. These are, of course, merely examples and are not intended to be limiting. For example, a figure may illustrate an exemplary embodiment with multiple features or combinations of features that are not required in one or more other embodiments and thus a figure may disclose one or more embodiments that have fewer features or a different combination of features than the illustrated embodiment. Embodiments may include some but not all the features illustrated in a figure and some embodiments may combine features illustrated in one figure with features illustrated in another figure. Therefore, combinations of features disclosed in the following detailed description may not be necessary to practice the teachings in the broadest sense and are instead merely to describe particularly representative examples. In addition, the disclosure may repeat reference numerals and/or letters in the various examples. This repetition is for the purpose of simplicity and clarity and does not itself dictate a relationship between the various embodiments and/or configurations discussed.

In this application, the use of the singular includes the plural, the word "a" or "an" means "at least one", and the use of "or" means "and/or", unless specifically stated otherwise. Furthermore, the use of the term "including", as well as other forms, such as "includes" and "included", is not limiting. Also, terms such as "element" or "component" encompass both elements or components comprising one unit and elements or components that comprise more than one unit unless specifically stated otherwise. In addition, the use of terms such as "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms such as "inboard," "outboard," "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

As used herein, the terms "connect," "connection," "connected," "in connection with," and "connecting" may be used to mean in direct connection with or in connection with via one or more elements. Similarly, the terms "couple," "coupling," and "coupled" may be used to mean directly coupled or coupled via one or more elements. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include such elements or features.

The term "substantially," "approximately," and "about" is defined as largely but not necessarily wholly what is specified (and includes what is specified; e.g., substantially 90 degrees includes 90 degrees and substantially parallel includes parallel), as understood by a person of ordinary skill in the art. The extent to which the description may vary will depend on how great a change can be instituted and still have a person of ordinary skill in the art recognized the modified feature as still having the required characteristics and capabilities of the unmodified feature. In general, but subject to the preceding, a numerical value herein that is modified by a word of approximation such as "substantially," "approximately," and "about" may vary from the stated value, for example, by 0.1, 0.5, 1, 2, 3, 4, 5, 10, or 15 percent.

The section headings used herein are for organizational purposes and are not to be construed as limiting the subject matter described. If any documents, or portions of documents, are cited in this application, including, but not limited to, patents, patent applications, articles, books, and treatises, such documents are hereby expressly incorporated herein by reference in their entirety for any purpose. In the event that one or more of such incorporated documents etc. and similar materials (if any) defines a term in a manner that contradicts the definition of that term in this application, this application controls.

Referring to the drawings wherein like characters are used for like parts throughout the several views, FIG. 1 illustrates an overview of various features of a wellhead system 1. The wellhead system 1 can be, but is not limited to, the types of wellhead systems that facilitate extraction of, for example, oil or gas from a reservoir through a well. As such, the wellhead system 1 is installed on a well, wherein the wellhead system 1 includes at least one tubing head and casing head and other internal components within the wellhead system 1, such as casing and tubing hangers. Components of the wellhead system 1 as shown in FIG. 1 may also include various other assemblies and packoffs (upper packoff 5 and lower packoff 10) and in particular one or more internal locking rings 15 of varying diameters and cross section proportions and that comprise a plurality of outer diameter grooves 20 and inner diameter grooves 25 and an outer beveled upper edge angle 41 and an outer beveled lower edge angle 42. Embodiments of such internal locking rings 15 are described in greater detail below in reference to FIGS. 2-7B.

As specifically shown in and with general reference to FIGS. 2-7B, the internal locking ring 15 is designed to lock a packoff into the housing of a wellhead system 1. As can be seen from FIG. 4, one embodiment of the internal locking ring 15 is generally circular in shape when viewed from a top view (although a bottom view is not depicted, it can be readily determined that the circular shape is the same) and has a relatively small cross section to accommodate a running tool of choice. Embodiments of the internal locking ring 15 are provided and disclosed in overall 11.125-inch and 13.75-inch diameters to accommodate the specific wellhead system 1 being used and/or other corresponding internal components such as packoffs and running tools. However, other embodiments contemplated can have any dimension that accomplishes the desired function. Although the disclosed embodiments are illustrated as having certain absolute and relative dimensions, those having skill in the art will recognize that the absolute and relative dimensions illustrated herein can be altered in accordance with varying design considerations. Other embodiments that do not have the same absolute and relative dimensions can be envisioned without departing from the scope of the claims. Moreover, the disclosed embodiments are not necessarily illustrated to scale.

Figure 5:
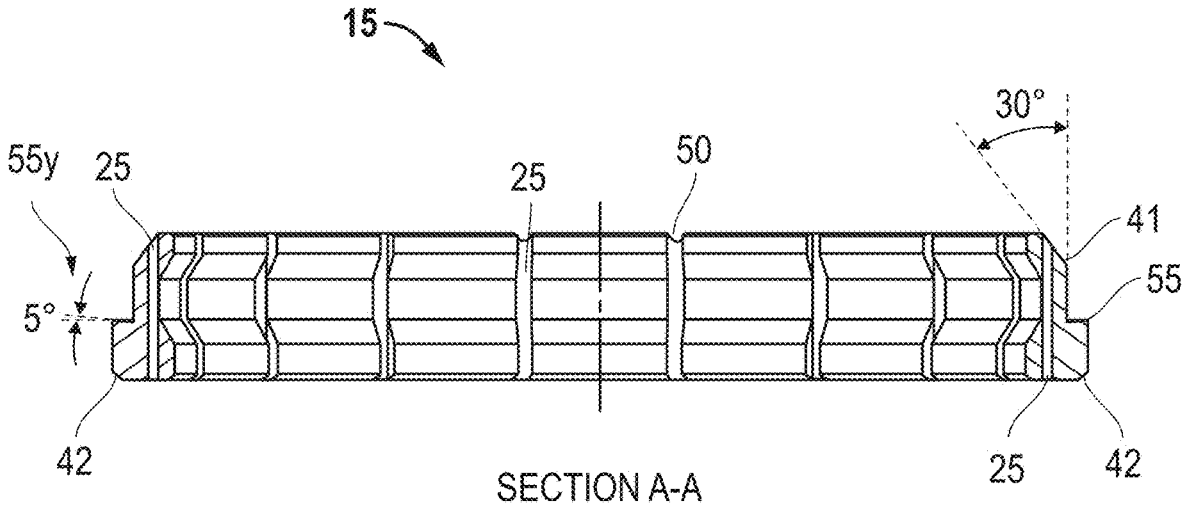
FIG. 5 illustrates a sectional elevation view of an internal locking ring according to an embodiment of the present disclosure.
Figure 6:
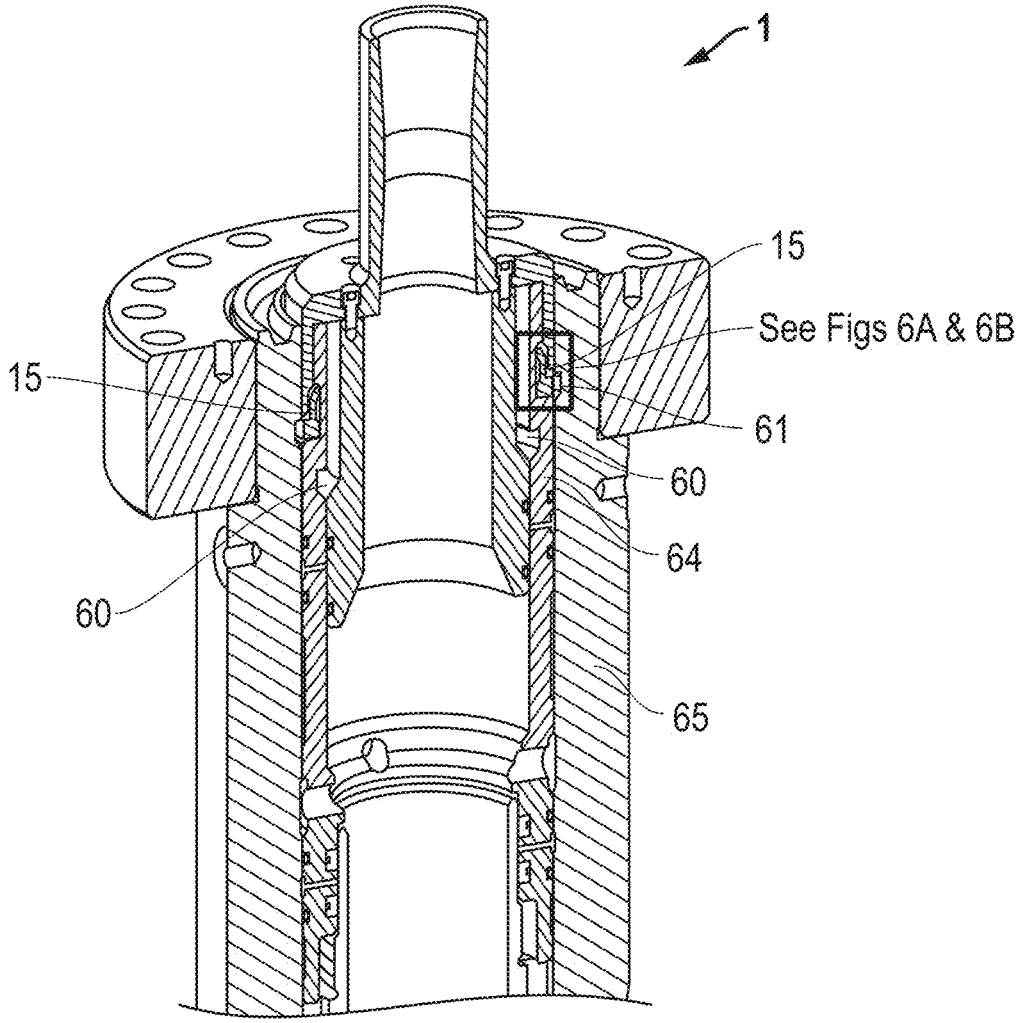
FIG. 6 illustrates a sectional perspective view of a wellhead depicting a larger diameter internal locking ring installed in accordance with one embodiment of the present disclosure.
Figure 6A:
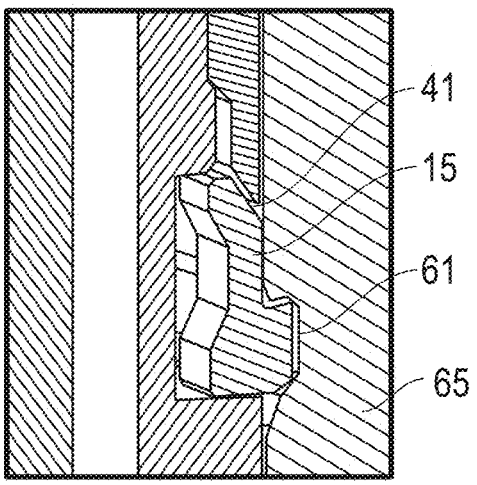
FIG. 6A illustrates a close-up sectional view of the larger diameter internal locking ring in FIG. 6 in an un-collapsed, locked configuration and positioned within a casing head seat in accordance with one embodiment of the present disclosure.
Figure 6B:
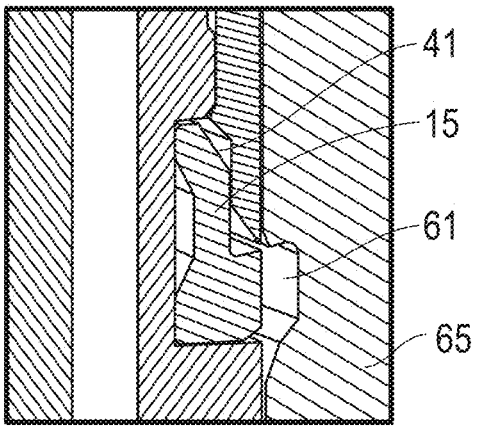
FIG. 6B illustrates a close-up sectional view of the larger diameter internal locking ring in FIG. 6 in a collapsed, unlocked configuration and not within a casing head seat in accordance with one embodiment of the present disclosure.

The internal locking ring 15 has an outer beveled upper edge 41 and an outer beveled lower edge 42. Both the outer beveled upper edge 41 and the outer beveled lower edge 42 of the internal locking ring 15 are in part designed with to marry with and into a casing head mating seat 61 having a mated shape angle that is formed into an adjacent portion of the casing head 65 (as shown in FIGS. 6, 6A and 6B) specifically in the case of use of an internal locking ring 15 having a larger diameter). Similarly, both the outer beveled upper edge 41 and the outer beveled lower edge 42 of the internal locking ring 15 are in part designed to marry with and into a packoff mating seat 60 having a mated shape angle that is formed into and adjacent portion of a packoff 64 (as shown in FIGS. 6, 7, 7A and 7B) specifically in the case of use of an internal locking ring having a smaller diameter). With reference to FIG. 5, the outer beveled lower edge 42 and the outer beveled upper edge 41 can be referenced. The angle to which both the outer beveled lower edge 42 and the outer beveled upper edge 41 is milled is in the range of 0-30 degrees. In the embodiment depicted in FIG. 5, the angles shown are about thirty degrees.

The internal locking ring 15 comprises a plurality of milled outer diameter grooves 20 and inner diameter grooves 25 disposed in both an inner diameter wall 30 as well as in an outer diameter wall 35 of the internal locking ring 15. The inner diameter wall 30 comprises a cross section having a back relief concave area 30 formed in and around the circumference of the inner diameter wall. The inner diameter grooves 25 and outer diameter grooves 20 are generally provided in the internal locking ring 15 having similar shape, form, and function to enable proper and effective compression by either an upper packoff 5 or lower packoff 10, as discussed hereinbelow. The internal locking ring 15 provides an opening 101 having opposing ends where each opposing end has chamfered corners 102, the opening 101 being disposed in the circumference of the internal locking ring 15 thereby creating a C-shaped ring and wherein threaded holes 103 are disposed in each of the opposing ends of the opening 101 in the circumference of the internal locking ring. As shown in at least FIG. 2, the vertical height of the inner diameter grooves 25 have a length greater than that of the outer diameter grooves 20. The inner diameter grooves 25 disposed on the inner diameter wall 30 and the outer diameter grooves 20 disposed on the outer diameter wall 35 of the internal locking ring 15 are disposed in such a way that an inner diameter groove 25 is not directly opposite from an outer diameter groove 20. As can be readily seen in FIG. 4, such separation is due to an about ten degree offset between each inner diameter groove 25 and each outer diameter groove 20.

Figure 2:
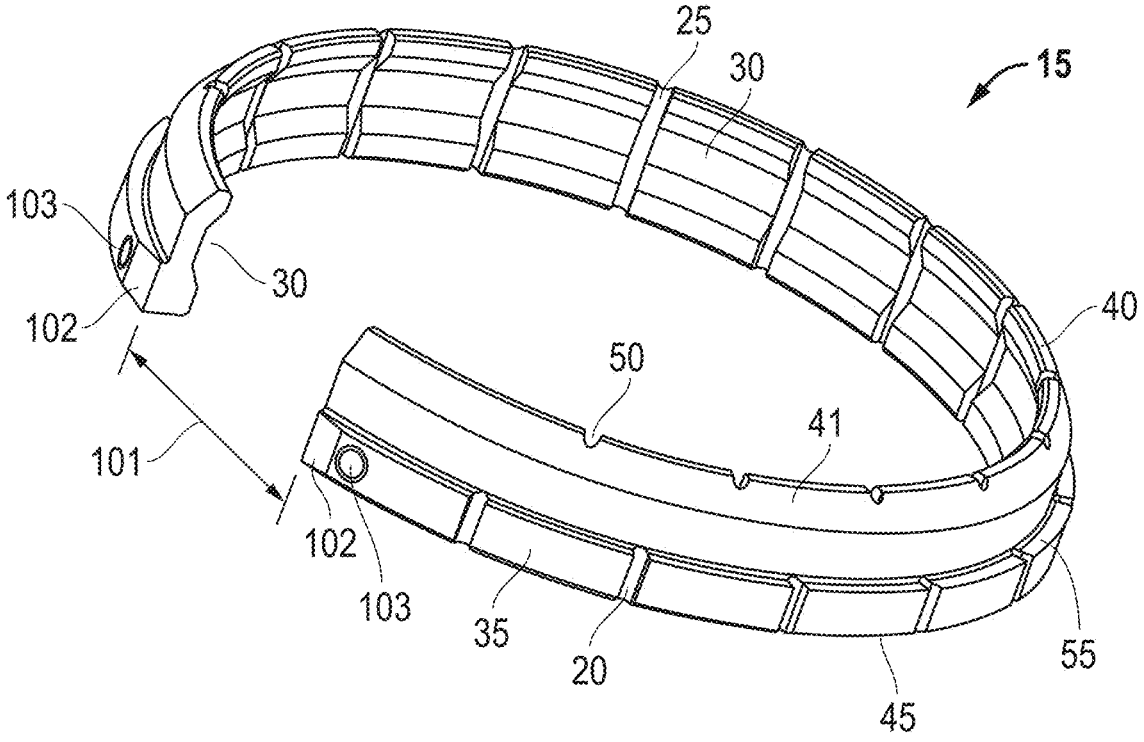
FIG. 2 illustrates a perspective view of an internal locking ring according to an embodiment of the present disclosure.
Figure 3:
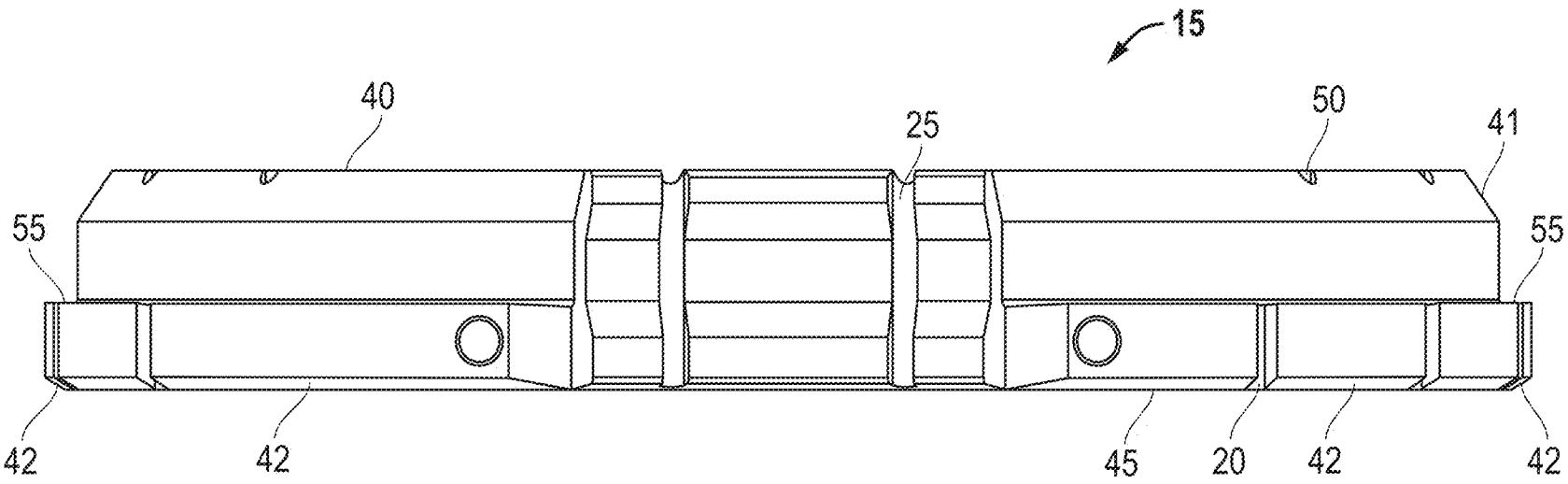
FIG. 3 illustrates an elevation view of an internal locking ring according to an embodiment of the present disclosure.
Figure 4:
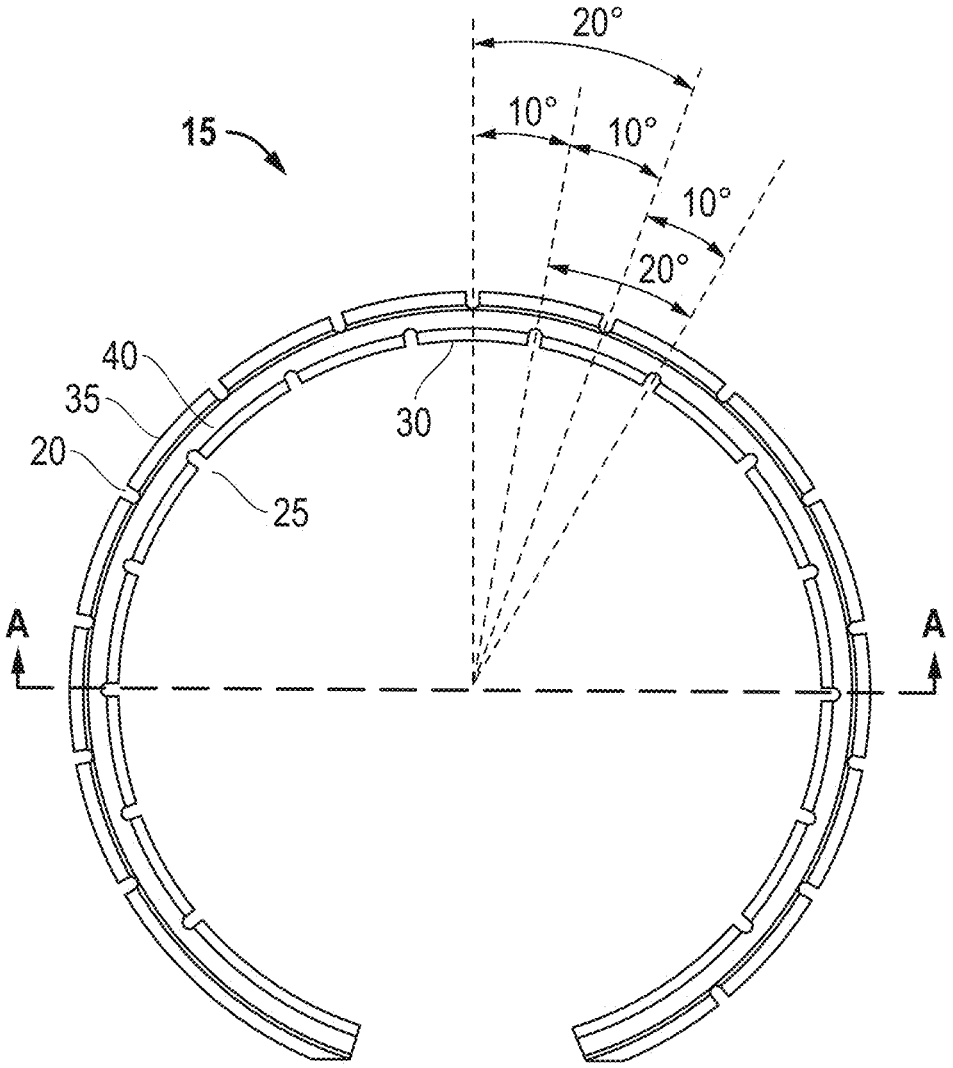
FIG. 4 illustrates a top view of an internal locking ring according to an embodiment of the present disclosure.

With reference to FIGS. 2, 3 and 5, the inner diameter grooves 25 extend from a top edge 40 to a bottom edge 45 of the internal locking ring 15 such that a portion of the inner diameter groove 25 intersects to create an intersection groove profile 50 along portions of the top edge 40 of the internal locking ring 15. Such intersection groove profile 50 is visible on the internal locking ring 15 when viewed as depicted in FIGS. 2, 3, and 5.

With further reference to FIGS. 2, 3, 4, and 5 the internal locking ring 15, further comprises a series of outer diameter grooves 20 also spaced generally equidistant around the outer diameter wall 35 of the internal locking ring 15. Such outer diameter grooves 20 extend from a bottom edge 45 of the internal locking ring 15 through a lip 55 formed on the outer diameter wall 35 of the internal locking ring 15. The lip 55 is clearly seen in FIGS. 2, 3 and 5. Such outer diameter grooves 20 are generally disposed in the outer diameter wall 35 and spaced apart in a twenty-degree equidistant fashion from each other around the outer diameter wall 35. Similarly, the inner diameter grooves 25 are generally disposed in the inner diameter wall 30 and spaced apart in a twenty-degree equidistant fashion from each other around the inner diameter wall 30 of the internal locking ring 15.

Figure 7:
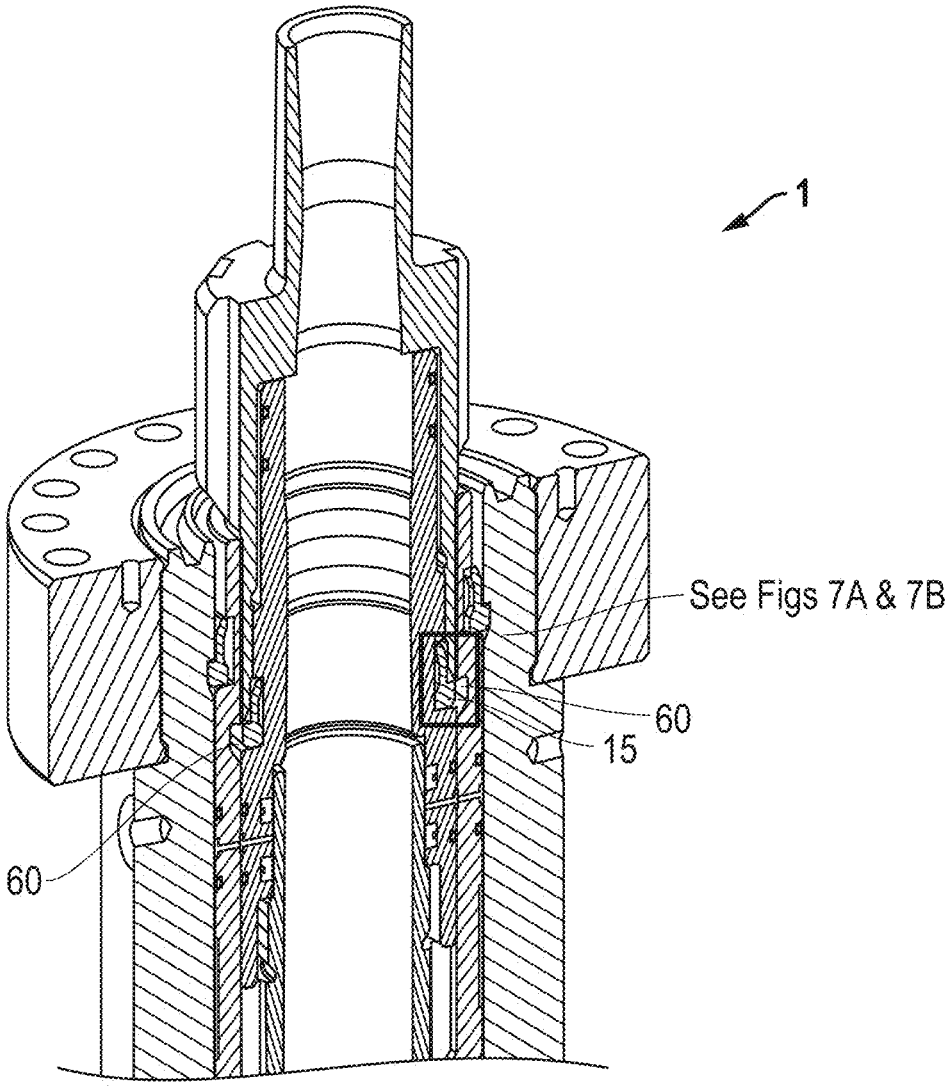
FIG. 7 illustrates a sectional perspective view of a wellhead depicting a smaller diameter internal locking ring installed in accordance with one embodiment of the present disclosure.
Figure 7A:
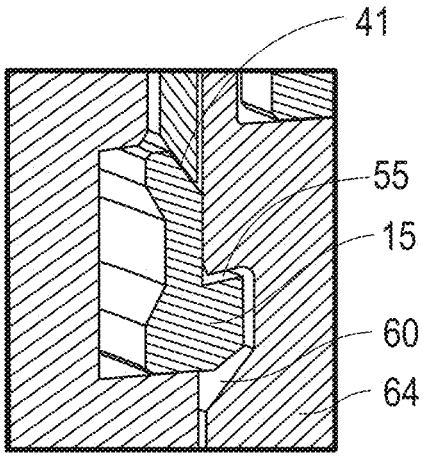
FIG. 7A illustrates a close-up sectional view of the smaller diameter internal locking ring in FIG. 7 in an un-collapsed, locked configuration and positioned within a packoff seat in accordance with one embodiment of the present disclosure.
Figure 7B:
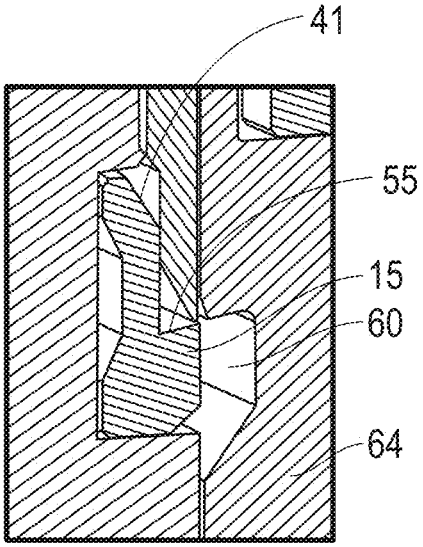
FIG. 7B illustrates a close-up sectional view of the smaller diameter internal locking ring in FIG. 7 in a collapsed, unlocked configuration and not within a packoff seat in accordance with one embodiment of the present disclosure.

As also shown in FIGS. 2, 3, 4, 5, 6A 6B, 7A, and 7B, the lip 55 can be milled to have a horizontal surface or an angled surface 55*y*. The angled surface 55*y* of the lip 55 can vary anywhere from about zero to five degrees from the horizontal (as shown specifically in FIG. 5). The lip 55 is structured to increase and improve the interfacing and interlocking with a packoff mating seat 60 when using a smaller diameter internal locking ring 15 or with a casing head mating seat 61 in the case of use with a larger diameter locking ring 15 (see FIGS. 6, 6A, 6B, 7A, and 7B). Thus, the intended purpose is to securely lock and retain the internal locking ring 15 in place when the internal locking ring 15 is in an un-collapsed, locked position (i.e., fully extended diameter) and resting within the seat channel. FIG. 6A shows a larger diameter internal locking ring 15 in an un-collapsed, locked position mated into the casing head mating seat 61. FIG. 6B shows the internal locking ring 15 in a collapsed, unlocked position from the casing head mating seat 61. Similarly, FIG. 7A shows a smaller diameter internal locking ring 15 in an un-collapsed, locked position mated into the packoff mating seat 61. FIG. 7B shows the smaller diameter internal locking ring 15 in a collapsed, unlocked position from the packoff mating seat 61.

FIGS. 5, 6A, 6B, 7A, and 7B provide a cross sectional view of the internal locking ring 15 wherein the inner diameter wall 30 comprises a concave area around the inner diameter wall 30 of the internal locking ring 15. The upper edge 40 of the internal locking ring 15 ends, due to the concavature of the inner diameter wall 30, wherein the concavature is in a generally thirty-degree inward casting angle to vertical.

Advantages of the internal locking ring 15 are noted in that stress points are absent when the milled outer diameter grooves 20 and inner diameter grooves 25 are present. Therefore, a running tool can more easily collapse the internal locking ring 15 due to a lower retrieving torque and force when trying to retrieve a packoff. Such lower retrieving torque and force allows the use of smaller cross sections for a running tool. The internal locking ring 15 of the present disclosure is manufactured from NACE compliant material AISI 4140 80 ksi minimum yield carbon steel. However, such material from which the internal locking ring 15 is manufactured are not meant to be limited only to such material.

In operational use the wellhead 1 is typically installed on a casing string before using the internal locking ring 15 After landing a mandrel casing hanger inside the wellhead 1, a packoff is then installed over a mandrel hanger to prevent any potential movement upward by downhole pressure acting on the mandrel hanger. An internal locking ring 15 according to embodiments of the present disclosure is squeezed and collapsed and is permitted due to the numerous inner diameter grooves 25 and outer diameter grooves 25 milled into the outer diameter wall 35 and inner diameter wall 30 of the internal locking ring 15. The squeezing and collapsing of the internal locking ring 15 is accomplished by a running tool around a packoff body that is lowered down over the mandrel hanger. Once the packoff is touching the mandrel hanger, the running tool rotates away from the packoff and allows the internal locking ring 15 to return to its un-collapsed, locked state (sprung out) into the casing head seat 61 (or packoff seat 60 as applicable). The internal locking ring 15 eventually cannot move out from the casing head seat 61 or packoff seat (as applicable) and engages more in the event of an upward acting force. By design, the internal locking ring 15 is "shear" and can accommodate a substantial amount of force before failure occurs.

Without further elaboration, it is believed that one skilled in the art can, using the description herein, utilize the present disclosure to its fullest extent. The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. An internal locking device, comprising:

an outer surface having a plurality of spaced grooves;

an inner surface having a concave area formed therein, wherein the inner surface further includes a plurality of spaced grooves; and wherein the internal locking device forms an opening with opposing ends, each opposing end having chamfered portions thereon.

2. The claim as in claim 1 wherein each of the opposing ends comprises apertures disposed therein.

3. The claim as in claim 2 wherein the opening formed with the opposing ends provides for a c-shaped ring.

4. The claim as in claim 1 wherein the concave area formed provides for a reduction in the forces required to collapse and energize the internal locking device.

5. The claim as in claim 1 wherein the inner surface spaced grooves are formed having a height greater than the plurality of spaced grooves on the outer surface.

6. The claim as in claim 1 wherein the inner surface plurality of spaced grooves are disposed in an angular offset position relative to the outer surface plurality of spaced grooves.

7. An internal locking ring, comprising:

an outer diameter wall having a plurality of spaced outer diameter grooves disposed therein;

an inner diameter wall having a back relief area formed therein, the inner diameter wall comprising a plurality of spaced inner diameter grooves disposed therein;

wherein the inner diameter grooves have a greater height than the outer diameter grooves, wherein the outer diameter grooves and the inner diameter grooves are generally equidistant from their adjacent grooves;

an opening formed through the inner and outer diameter walls of the internal locking ring, the opening having opposing ends;

wherein the internal locking ring further comprises an outer beveled upper edge and an outer beveled lower edge, each beveled at an angle of about 30 degrees, and each configured to mate with a corresponding angled seat formed in a packoff or a casing head; and, wherein the inner diameter grooves extend to a top edge of the internal locking ring and define an intersection groove profile along the top edge.

8. The claim as in claim 7 wherein the inner diameter grooves are disposed in an angular offset position relative to the outer diameter grooves.

9. The claim as in claim 7 wherein each of the opposing ends comprises threaded holes disposed therein.

10. The claim as in claim 7 wherein the opening formed has opposing ends and provides for a c-shaped ring.

11. The claim as in claim 7 wherein the opposing ends have chamfered corners.

12. The claim as in claim 7 wherein the back relief area formed provides for a reduction in the forces required to collapse and energize the internal locking ring.

13. The claim as in claim 7 wherein the inner diameter wall plurality of spaced inner grooves are formed having a height greater than the plurality of spaced grooves on the outer diameter wall.

14. The claim as in claim 13 wherein the outer diameter wall protrudes from an adjacent wall portion of an outer surface of the ring, wherein the outer diameter wall has a lip and a plurality of spaced outer diameter grooves disposed therein the wall.

15. An internal locking ring, comprising:

an outer diameter wall having a plurality of spaced outer diameter grooves disposed therein, wherein the outer diameter wall protrudes from an adjacent wall portion of an outer surface of the ring;

an inner diameter wall having a back relief area formed therein, the inner diameter wall comprising a plurality of spaced inner diameter grooves disposed therein;

wherein the inner diameter grooves have a greater height than the outer diameter grooves, wherein the outer diameter grooves and the inner diameter grooves are generally equidistant from their adjacent grooves;

an opening formed through the inner and outer diameter walls of the internal locking ring, the opening having opposing ends; and threaded holes disposed in each of the opposing ends of the opening.

16. The claim as in claim 15 wherein the opening formed has opposing ends and provides for a c-shaped ring.

17. The claim as in claim 16 wherein the opposing ends have chamfered corners.

18. The claim as in claim 15 wherein the back relief area formed provides for a reduction in the forces required to collapse and energize the internal locking ring.

19. The claim as in claim 15 wherein the internal locking ring further comprises an outer beveled upper edge milled to angle from 0 to 30 degrees.

20. The claim as in claim 19 wherein the internal locking ring further comprises an outer beveled upper edge milled to an angle of about 30 degrees.

21. The claim as in claim 15 wherein the outer diameter grooves extend from a bottom edge of the internal locking ring through a lip formed on the outer diameter wall of the internal locking ring.

* * * * *